US009540073B1

(12) United States Patent
Foucher et al.

(10) Patent No.: US 9,540,073 B1
(45) Date of Patent: Jan. 10, 2017

(54) LIGHTWEIGHT PERSONAL WATERCRAFT

(71) Applicant: Roundabout Watercrafts, LLC, Ruskin, FL (US)

(72) Inventors: Curtis Todd Foucher, Ruskin, FL (US); Scott Edward Williams, Eaton Park, FL (US)

(73) Assignee: ROUNDABOUT WATERCRAFTS LLC, Ruskin, FL (US)

( * ) Notice: Subject to any disclaimer, the term of this patent is extended or adjusted under 35 U.S.C. 154(b) by 0 days.

(21) Appl. No.: 14/821,286

(22) Filed: Aug. 7, 2015

(51) Int. Cl.
*B63B 3/00* (2006.01)
*B63B 1/04* (2006.01)

(52) U.S. Cl.
CPC ..... *B63B 1/041* (2013.01)

(58) Field of Classification Search
CPC ..... B63B 1/00; B63B 1/041; B63B 2001/00
USPC ..... 114/56.1, 61.32, 343, 346; 441/65, 67, 441/129–131
See application file for complete search history.

(56) References Cited

U.S. PATENT DOCUMENTS 3,439,366 A * 4/1969 Matthews ..... B63B 5/24 114/357
3,710,408 A * 1/1973 Sorenson ..... B63B 1/041 114/346
3,787,912 A * 1/1974 Huey, Jr. ..... B63B 1/041 114/351
4,021,873 A 5/1977 Francois
4,273,060 A * 6/1981 Pavincic ..... B63B 1/041 114/102.22
4,305,170 A * 12/1981 Atherton ..... B63C 13/00 114/346
4,516,943 A * 5/1985 Spieldiener ..... B63B 1/041 114/123
4,730,572 A * 3/1988 Hollingsworth ..... B63B 1/041 114/152
4,878,980 A * 11/1989 Stedman ..... B63B 35/7906 156/299
5,331,914 A * 7/1994 Salmons ..... B63B 35/76 114/125
5,375,551 A * 12/1994 Lunter ..... B63H 11/113 114/145 R
6,543,378 B1 4/2003 Johnson, Sr.
6,962,124 B1 * 11/2005 North ..... B63B 1/041 114/346
8,047,886 B1 * 11/2011 McLarty ..... B63B 7/06 114/346
8,789,487 B2 * 7/2014 Lizzio ..... B63B 35/731 114/346
2013/0199431 A1 * 8/2013 Nemeth ..... B63B 1/041 114/151
2014/0020612 A1 * 1/2014 Lizzio ..... B63B 35/731 114/55.56

* cited by examiner

*Primary Examiner* — Daniel V Venne
(74) *Attorney, Agent, or Firm* — Shumaker, Loop & Kendrick, LLP

(57) ABSTRACT

A substantially circular watercraft has a buoyant, generally toroidal hull supporting a rigid deck with an outer periphery in substantial conformance with the perimeter of the hull. The deck has an opening located above the central opening of the hull to permit placement of power means to drive and steer the watercraft. The hull is made of a substantially rigid material and in a preferred embodiment the hull and deck are formed from a molded plastic. The leading edge of the watercraft is equipped with a "Carolina flare" which provides greater ease of movement through the water.

13 Claims, 6 Drawing Sheets

LIGHTWEIGHT PERSONAL WATERCRAFT

FIELD OF THE INVENTION

This invention relates to the field of personal watercrafts.

BACKGROUND

Single person watercraft, such as those that can be used for fishing, which can be transported to the water's edge and launched without a boat trailer or a launch ramp are very popular in some circles since they enable the fisherman to get on the water without a major financial investment. They also allow access to many smaller or hard to reach bodies of water that would be totally inaccessible with a full-size boat and trailer. Moreover, personal and lightweight watercraft can be less obtrusive, making the boating and fishing experience more enjoyable.

However, one-man boats which are currently commercially available also have a number of shortcomings. For example, one type of such boat is known as a "floater" or "belly boat" in which the fisherman rides along in an inflated inner tube with his legs and feet dangling down below the tube. The fisherman frequently uses fins or other propelling devices secured to his feet or legs to propel the floater through the water when he wants to change from one fishing spot to the next. Obviously, the fisherman is seriously limited in the amount of equipment he can take along, and forcing him to partially submerge himself in order to make the floater work properly has a number of drawbacks. In addition, visibility is somewhat sacrificed, since eye level is so close to the water. Casting and retrieving may also be more difficult.

Another type of one-man craft is simply a very small boat in which the fisherman is completely up out of the water, riding inside the protected hull of the craft. Such boats are typically propelled either by small electric or gasoline motors, or by paddles and oars. However, while the fisherman remains high and dry out of the water in such a craft, its stability may be sacrificed because of the relatively elevated position of the operator. In many instances, the boat presents rather cramped quarters, particularly when tackle boxes, poles, and other items are carried on board.

SUMMARY OF THE INVENTION

In a first embodiment, the invention includes a watercraft with a substantially circular hull having a leading end, a trailing end, a top wall, an outer annular sidewall and an inner annular sidewall. A recessed deck extends the distance between diametrically opposed portions of the inner sidewall so as to present a closed top for the hull. A bottom extends completely across the bottom of the hull, leading end and trailing end thereby defining an interior volume. The leading of the hull projects upwardly from the bottom to the annular top wall of the hull. Preferably the hull, deck and bottom are formed from a molded resin.

In one embodiment the recessed deck is substantially parallel to the bottom. Here, the recessed deck connects to the inner annular sidewall at a substantially right angle. A port extends through the deck to the bottom through the interior volume.

In another embodiment the trailing end is substantially flat. The hull has a longitudinal axis extending from the leading end to the trailing end thereof and the trailing end is substantially perpendicular to the longitudinal axis. The trailing end is wider at the top wall than at the bottom.

In yet another embodiment the leading end comprises a lower wall projecting upward from the bottom and an upper wall extending upward from the lower wall at one end and connecting to a portion of the top wall. Handholds formed in the underside of the top wall projecting over the upper wall.

The bottom of the watercraft comprises a plurality of strakes. In this embodiment, as before, the hull has a longitudinal axis extending from the leading end to the trailing end thereof and the strakes run parallel to the longitudinal axis. The bottom comprises at least a pair of strakes each one disposed parallel to the longitudinal axis of the watercraft and extending the length of the bottom at a point midway between a centerline of the watercraft and the outer extent of the annular sidewall. Preferably the bottom comprises at least one strakes along a portion of the centerline of the watercraft.

DESCRIPTION OF THE PREFERRED EMBODIMENTS

Figure 1:
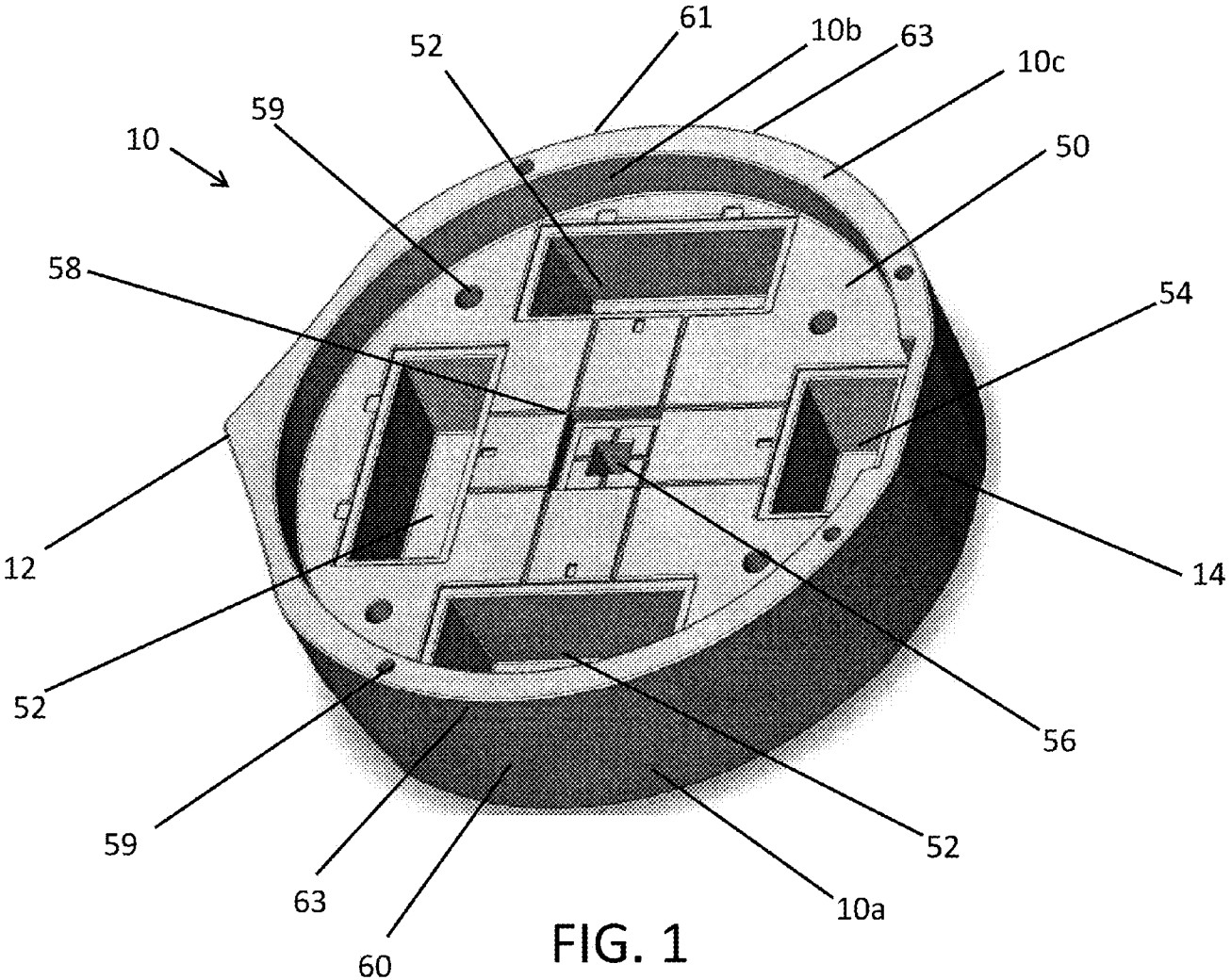
FIG. 1 is a perspective view of one embodiment of the inventive watercraft.

With reference now to the figures, a preferred embodiment of the present invention comprises watercraft 1 adapted for use as a small, personal watercraft. The vessel of the present invention includes a substantially circular hull broadly denoted by the numeral 10 having an outer annular sidewall 10*a*, an inner annular sidewall 10*b* (having a circular shape forming an inner diameter of the hull) and top wall 10*c* (i.e., flat wall positioned between inner annular sidewall and outer annular sidewall). The substantially circular shape of hull 10 is disrupted by leading end 12 and trailing end 14, discussed in greater detail below. Bottom 90 (i.e., bottom wall) extends completely across the bottom of the hull 10, and leading and trailing ends 12/14, to provide a closed bottom for craft 1, except for certain open or cutout areas in the bottom 90 (i.e., bottom wall). Likewise, deck 50 covers the top of hull 10 and completely spans the distance between diametrically opposed portions of the outer sidewalls so as to present a closed top for the hull, except for a number of special openings, as will also be described below. As a result of this construction, craft 1 is closed along its top, bottom, and opposite sides defining an interior volume as well as providing buoyancy. Preferably, the components of craft 1 are constructed from a suitable synthetic resinous material so as to be molded using conventional plastic molding techniques and equipment.

Figure 3:
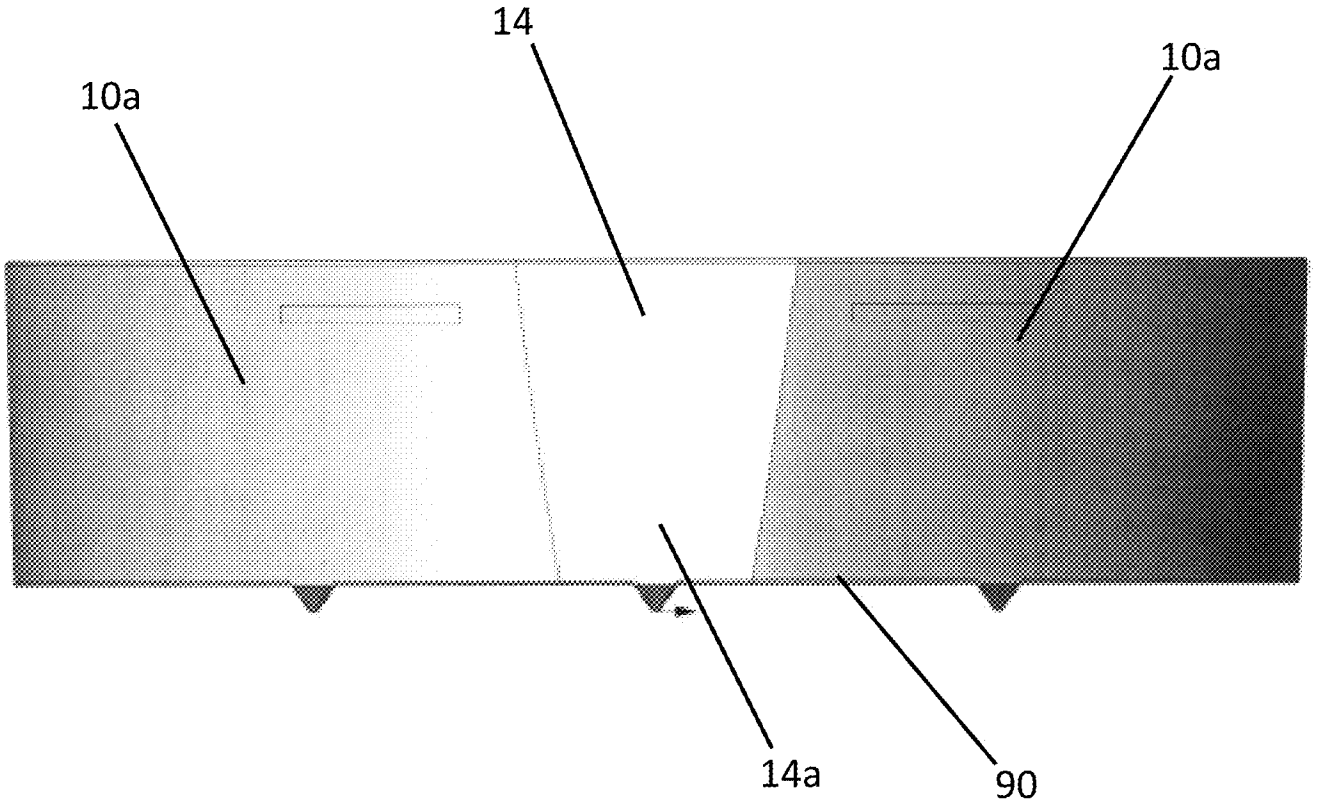
FIG. 3 is a rear view of one embodiment of the inventive watercraft.

Hull 10 and deck 50 share a common vertical axis and a planar horizontal axis. In the embodiment depicted in the figures, craft 1 is substantially circular in a horizontal plane parallel to axis B, with the exceptions of leading and trailing ends 12 and 14. Therefore, substantially circular, craft 1 has an inherent bow (leading end 12) and stern (trailing end 14), wherein two opposing arcuate shaped sidewalk 60, 61 that are each directly connected to a bow 12 and a stern 14 thereby forming an outer diameter 63 of the hull. As shown in FIGS. 1 and 3, the stern is substantially flat in a direction extending from the bottom wall to the flat wall that forms the upper circumference of the hull such that the bow is perpendicular relative to the bottom wall. The presence of the inherent bow and stern do not, however, limit forward motion of craft 1 in the direction of leading end 12, therefore allowing the craft to take advantage of its otherwise substantially circular shape. One having ordinary skill in the art will recognize that craft 1 can comprise other shapes (not shown) such as ovoid, which may or may not include a defined bow and stern.

Figure 2:
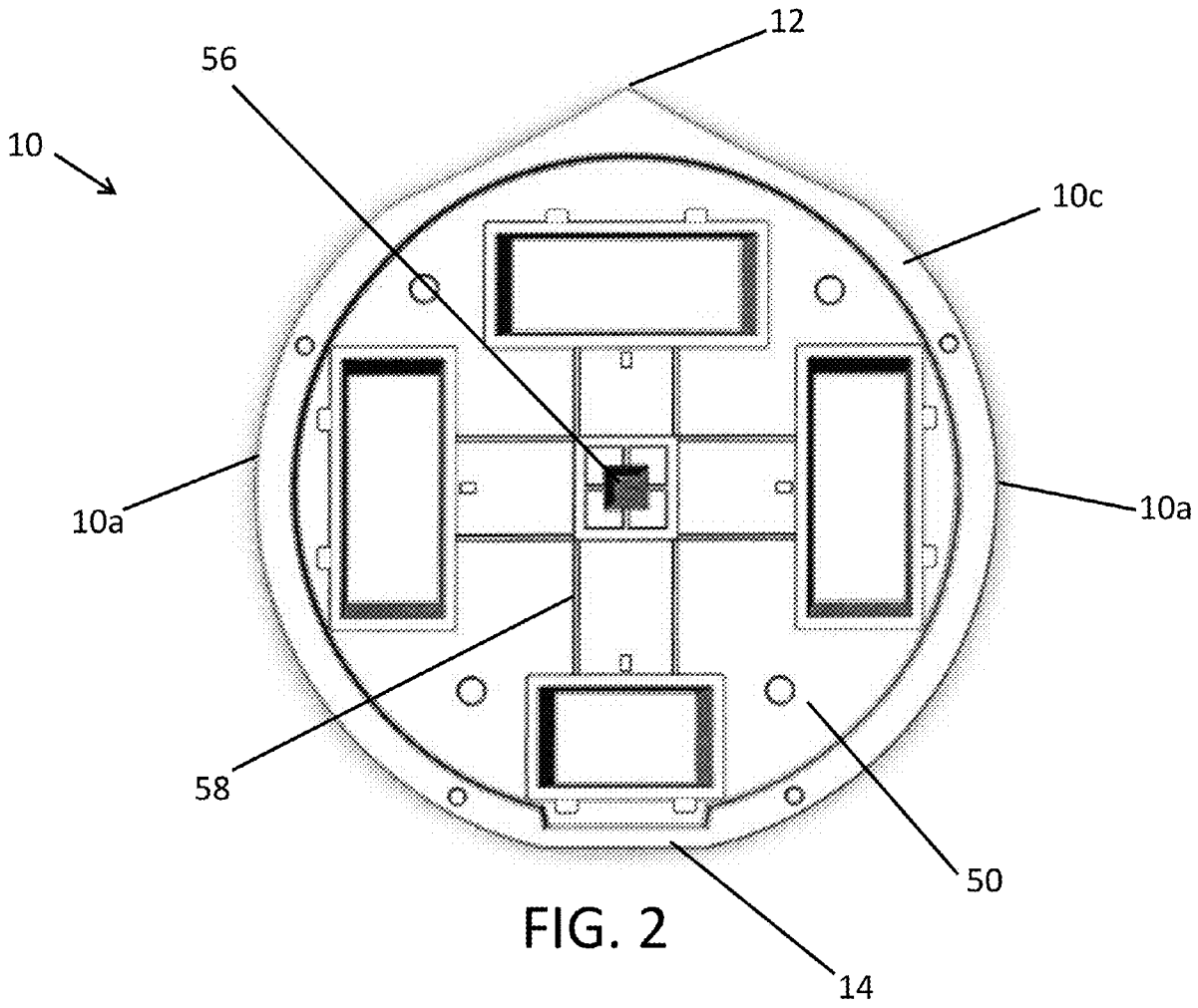
FIG. 2 is a top plan view of one embodiment of the inventive watercraft.

As seen in FIGS. 1-2, deck 50 sits within hull 10 and, preferably, at a height lower than that of the upper extent of hull 10 thereby forming interior hull wall 10*a*. Interior wall 10*a* is preferably at a substantially right angle to deck 50. This arrangement maximizes critical deck area needed for operation of the vessel particularly during use as a fishing vessel or at other times that standing is required.

Deck 50 can include compartments 52 which extend downward into the interior volume. These compartments can provide general storage and equipped with a sealable lid (not shown). Optionally, one or all compartments can provide specialized storage such as being insulated to provide a cooler-type storage or can be equipped to serve as a live well for fish. In a preferred embodiment, compartment 54 is disposed adjacent trailing end 14 and is sealed. This provides battery storage for an electric motor (not shown) used to propel the craft. Trailing end 14 is preferably flattened, relative to the substantially circular sides of hull 10 to allow easy mounting of an electric motor.

Continuing with reference to FIGS. 1-2, deck 50 includes a centralized mounting port 56 to allow the attachment of a chair to deck 50. Port 56 extends downward into the interior volume to allow deep setting of the chair pedestal which accommodates to torsion forces placed on deck 50 when the chair is occupied as well as being rotated. Portal 56 can be recessed within, or flush to, deck 50. Channels 58 formed in deck 50 allow water to be directed toward or away from compartments 52 as needed. Water on deck 50 can be directed to appropriate places for drainage via channels 58 thereby keeping the deck free of standing water. Receptacles 59 can be formed in deck 50 and/or hull 10 to provide cup holders, rod holders or accept specialty equipment (such as racks and/or sunshades).

Figure 4:
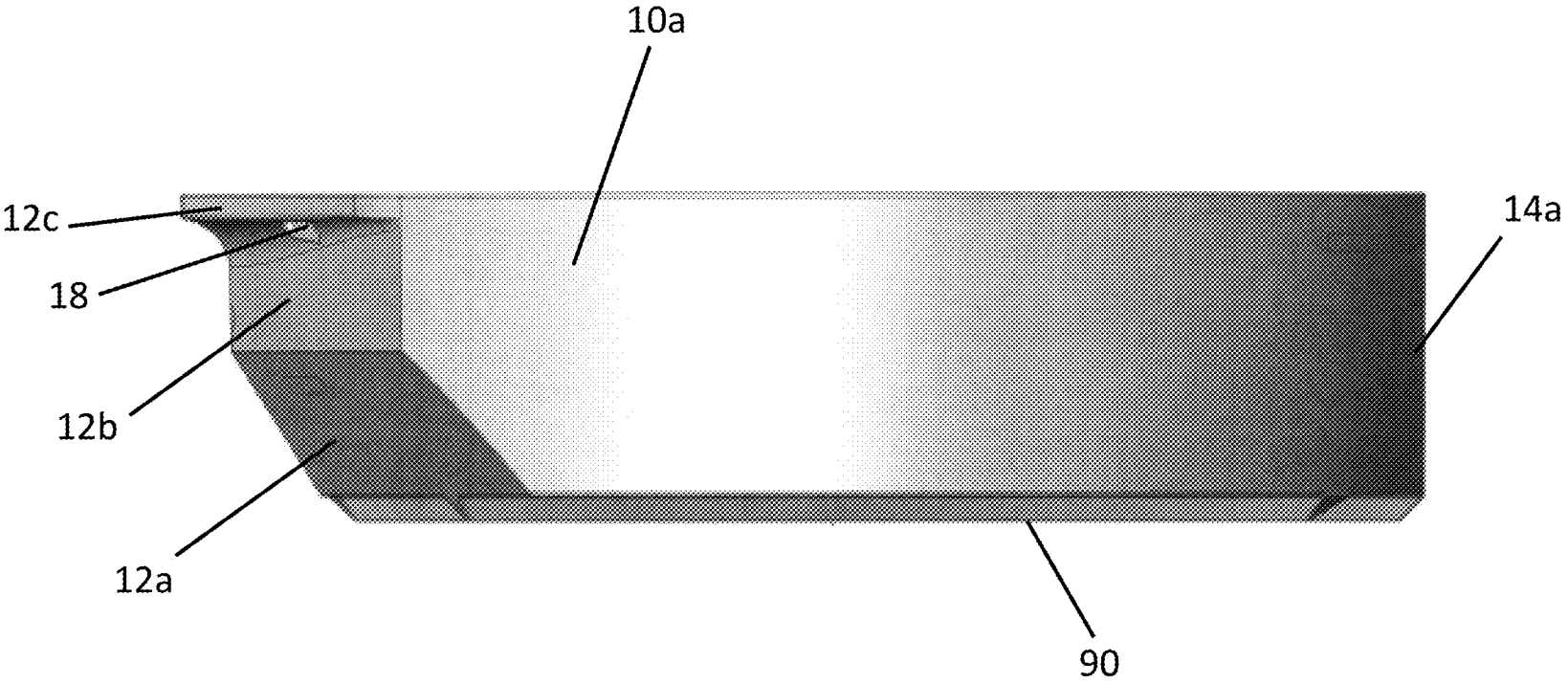
FIG. 4 is a side view of one embodiment of the inventive watercraft.

Referring now to FIGS. 3 and 4, the inventive features of hull 10 can be seen. As shown in FIG. 3, and as discussed above, the substantially circular shape of hull 10 is disrupted at trailing end 14 which forms a substantially flat surface 14*a*. Surface 14*a* is positioned and sized to receive a propulsion means (not shown) such as an electric or gas powered motor.

Figure 5:
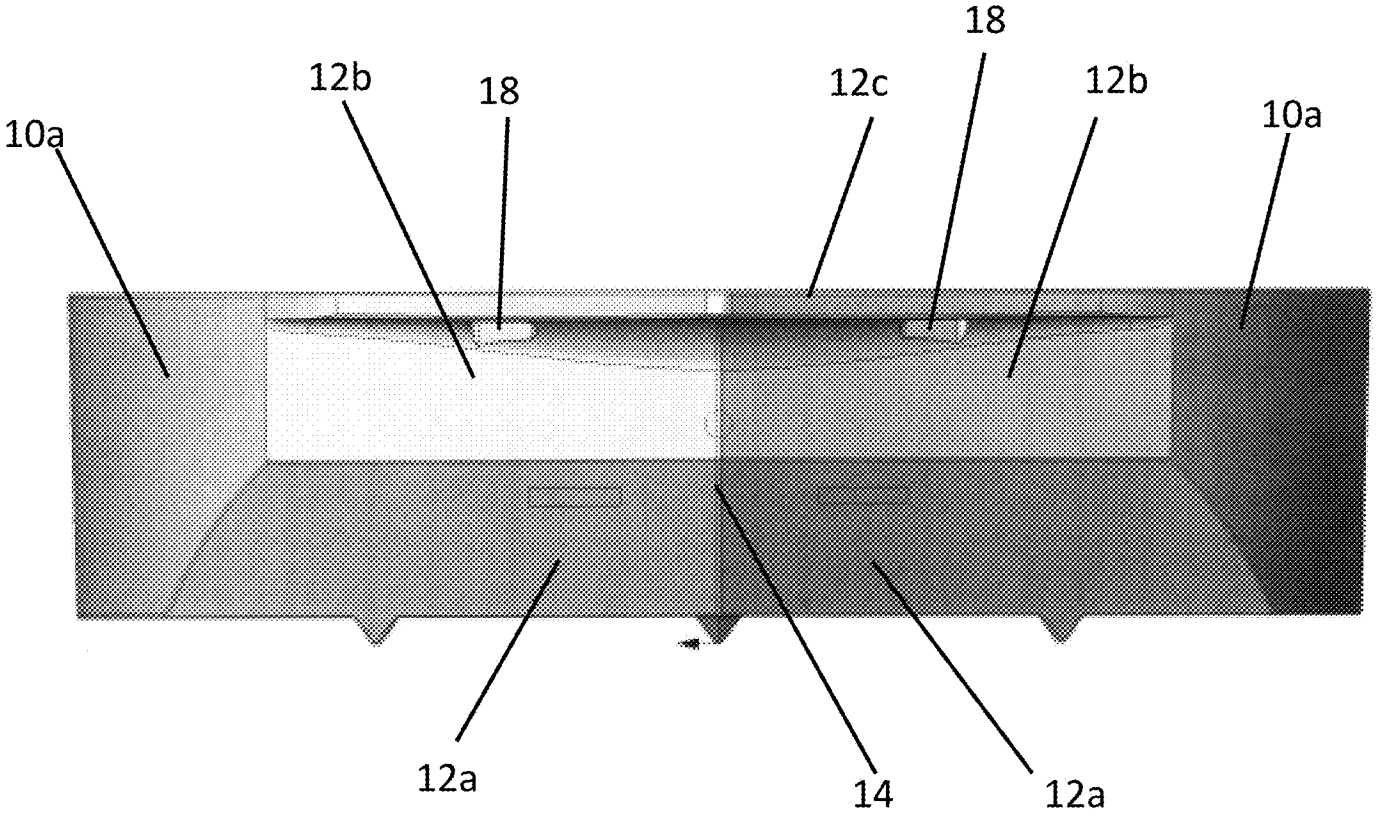
FIG. 5 is a front view of one embodiment of the inventive watercraft.

Leading end 12 is shown in greater detail in FIGS. 4 and 5. The substantially circular shape of hull 10 is disrupted at leading end 12. Leading end 12, which defines the bow of the vessels, comprises outwardly curved lower wall 12*a* which extends upward from bottom 90 at an angle. Upper wall 12*b* extends upwardly from lower wall 12*a* at an approximate right angle (directly connected, angled sidewalls), although those of skill in the art will appreciate the deviation from a right angle is contemplated without retaining the substantially circular shape of hull 10. Upper wall 12*b* ends at lip 12*c* which extends outward and over upper wall 12*b* and lower wall 12*a*. In a preferred embodiment, handholds 18 are formed in upper lip 12*c* to ease handling of craft 1.

The features of leading end 12 allow the shape of lower wall 12*a* and upper wall 12*b* define prow 14 which gives craft 1 a Carolina flare, giving it superior hydrodynamic qualities over personal watercraft of the prior art.

Figure 6:
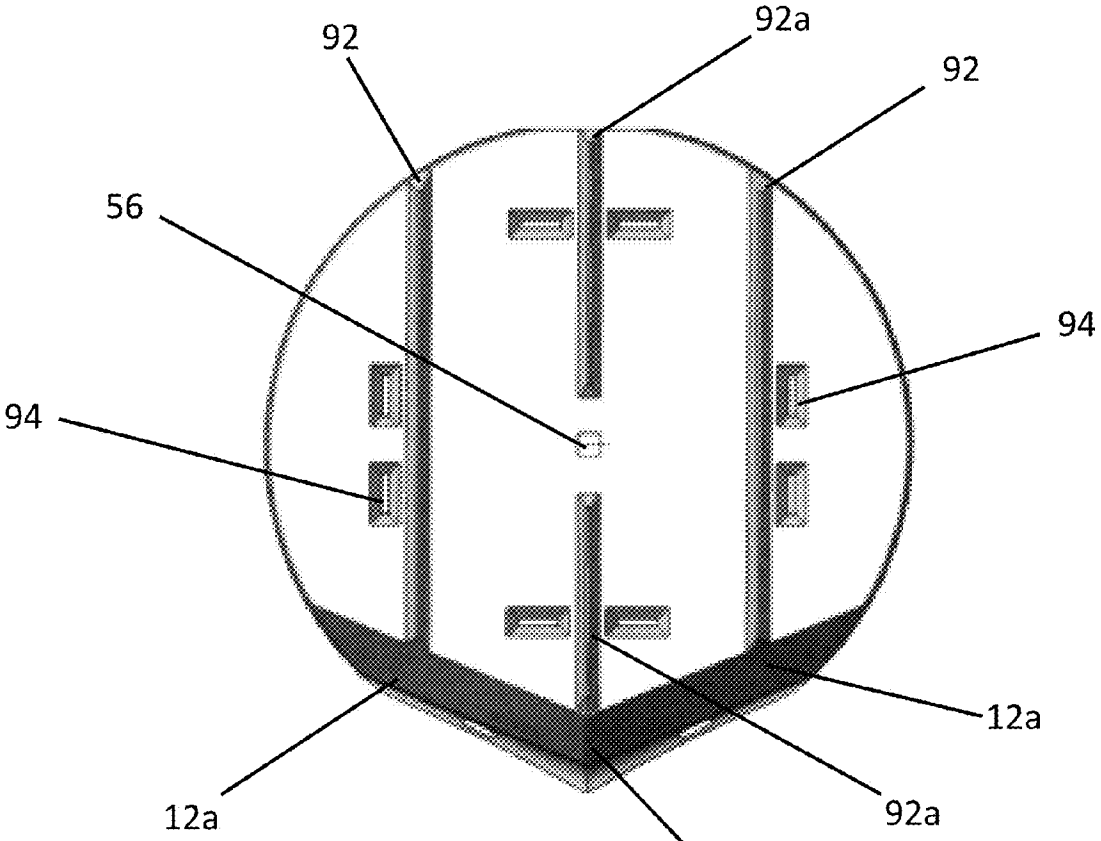
FIG. 6 is a bottom view of one embodiment of the inventive watercraft.

Bottom 90 of craft 1 is detailed in FIG. 6. As shown, bottom 90 is substantially flat and follows the shape of the vessel dictated by the circular shape of hull 10, as well as leading end 12 and trailing end 14. In a preferred embodiment, upper lip 12*c* extends further forward than the leading end of bottom 90.

In the embodiment shown in FIG. 6, port 56 disposed in deck 50 (see FIGS. 1 and 2) extends downward through the vessel and opens at bottom 90. This allows for both greater anchoring of a chair (not shown) as well as drainage from deck 50. The interior walls of port 56 in this embodiment are sealed to preserve the integrity of the interior volume defined by hull 10, deck 50 and bottom 90. This feature is accomplished as part of the preferable molding process used in the construction of the vessel.

Bottom 90 also includes strakes 92 and 92*a*. In this embodiment, strakes 92 run lengthwise (relative to leading end 12 and trailing end 14) and are positioned approximately midway between the centerline of the vessel and the outer extent of hull 10. Strakes 92*a* also run lengthwise (relative to leading end 12 and trailing end 14) but are positioned along the centerline of the vessel on either side of port 56. In a preferred embodiment the strakes have a substantially triangular cross-section. Other arrangements, including rounded and/or circular (e.g. pontoon) arrangements are also contemplated.

Depressions 94, are formed in bottom 90 adjacent strakes 92/92*a*. The term "depression" is used relative to the orientation shown in FIG. 6 as during normal operation of craft 1, depressions 94 extend upward from bottom 90 into the interior volume.

The preceding description was provided to illustrate the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A watercraft comprising:

(a) a substantially circular hull formed by a continuous outer annular wall directly connected to a bottom wall, the continuous outer annular wall having two opposing arcuate shaped sidewalls that are each directly connected to a bow and a stern thereby forming an outer diameter of the hull;

(b) an inner annular sidewall that is spaced apart from but connected to the continuous outer annular wall by a flat wall that forms an upper circumference of the hull, the inner annular sidewall forming an inner diameter of the hull defining a recess in the hull; and (c) a recessed deck formed in the inner diameter of the hull that is connected to the inner annular sidewall, the recessed deck configured to receive a seat thereon, wherein:

the bow is formed of directly connected, angled sidewalls that extend outwardly away from the bottom wall in a direction towards the flat wall that forms the upper circumference of the hull, and the stern is substantially flat in a direction extending from the bottom wall to the flat wall that forms the upper circumference of the hull such that the stern is perpendicular relative to the bottom wall and is configured for mounting a motor thereon.

2. The watercraft of claim 1, further comprising at least one drainage through hole having an inlet formed on the recessed deck that is in fluid communication with an outlet formed on the bottom wall of the hull.

3. The watercraft of claim 1, further comprising a plurality of storage compartments that are recessed within and radially positioned about a center of the recessed deck.

4. The watercraft of claim 3, wherein at least one of the plurality of storage compartments has a drainage through hole formed thereon such that liquid is drained from the at least one storage compartment through the substantially circular hull.

5. The watercraft of claim 4, wherein a drainage channel is formed on a planar surface of the recessed deck such that liquid is channeled away from the recessed deck to the drainage through hole.

6. The watercraft of claim 5, wherein a plurality of strakes are formed on the bottom wall, each strake extending from the bow towards the stern.

7. The watercraft of claim 6, wherein the plurality of strakes comprise a first strake continuously extending from the bow towards the stern, a third strake continuously extending from the bow towards the stern, and a second strake positioned between the first and third strakes that discontinuously extends from the bow to the stern.

8. The watercraft of claim 7, further comprising recessed receptacles for receiving beverages, fishing rods, or a combination thereof formed in the flat wall that forms the upper circumference of the hull.

9. The watercraft of claim 1, wherein the recessed deck comprises a vertically oriented opening positioned in the center of the recessed deck and a four spaced apart storage compartments positioned radially around the center of the recessed deck.

10. The water craft of claim 9, further comprising a drainage through hole and drainage channel formed on the recessed deck such that liquid on the recessed deck is directed to the drainage channel, which is directed to and drained from the drainage channel.

11. The water craft of claim 10, further comprising a first strake continuously formed on the bottom wall extending from the bow towards the stern, a third strake formed on the bottom wall extending from the bow towards the stern, and a second strake formed on the bottom wall positioned between the first and third strakes that discontinuously extends from the bow to the stern.

12. The water craft of claim 11, wherein recessed receptacles for receiving beverages, fishing rods, or a combination thereof are formed on the flat wall that forms the upper circumference of the hull.

13. The water craft of claim 12, further comprising a handle formed on the substantially circular hull for gripping and/or handling the watercraft.

* * * * *